US011772843B1

(12) United States Patent
DuBois et al.

(10) Patent No.: US 11,772,843 B1
(45) Date of Patent: Oct. 3, 2023

(54) EYE SHIELD DISPENSERS

(71) Applicant: Embrace Healthcare, LLC, Nashua, NH (US)

(72) Inventors: Eugene W. DuBois, Nashua, NH (US); Michael Borski, Methuen, MA (US); Joel Depina, Methuen, MA (US); Phillip D. Peery, Powell, TN (US)

(73) Assignee: Embrace Healthcare, LLC, Nashua, NH (US)

( * ) Notice: Subject to any disclaimer, the term of this patent is extended or adjusted under 35 U.S.C. 154(b) by 0 days.

(21) Appl. No.: 17/592,493

(22) Filed: Feb. 3, 2022

Related U.S. Application Data

(63) Continuation of application No. 16/782,491, filed on Feb. 5, 2020, now Pat. No. 11,273,951.

(60) Provisional application No. 62/805,326, filed on Feb. 14, 2019.

(51) Int. Cl.

| | |
|---|---|
| ***B65D 5/72*** | (2006.01) |
| ***B65D 5/50*** | (2006.01) |
| ***B65D 85/62*** | (2006.01) |
| ***B65D 85/00*** | (2006.01) |

(52) U.S. Cl.
CPC ..... *B65D 5/725* (2013.01); *B65D 5/5035* (2013.01); *B65D 5/724* (2013.01); *B65D 85/00* (2013.01); *B65D 85/62* (2013.01)

(58) Field of Classification Search
CPC .... B65D 5/729; B65D 5/5023; B65D 5/5035; B65D 5/724; B65D 5/725; B65D 17/161; B65D 85/00; B65D 85/62; B65D 2583/00
USPC ..... 221/303
See application file for complete search history.

(56) References Cited

U.S. PATENT DOCUMENTS

| | | | | |
|---|---|---|---|---|
| 3,040,881 | A * | 6/1962 | McNeil | A47F 7/021 206/5 |
| 3,351,208 | A * | 11/1967 | Siegel | A47F 7/021 248/902 |
| 3,836,007 | A * | 9/1974 | Rosenwein | A47F 7/021 116/75 |
| 3,858,726 | A * | 1/1975 | Rosenwein | A47F 7/021 206/5 |
| 3,891,092 | A * | 6/1975 | Surrette | A47F 7/021 211/163 |
| 3,924,750 | A * | 12/1975 | Dunchock | A47F 7/021 248/902 |
| 4,150,752 | A * | 4/1979 | Breining | A47F 7/021 211/2 |
| 4,211,331 | A * | 7/1980 | Salmon | A47F 5/02 211/163 |
| 6,443,317 | B1 * | 9/2002 | Brozak, Jr. | A47F 7/021 211/85.1 |
| 9,546,031 | B2 * | 1/2017 | Healy | B65D 77/0413 |
| 10,543,955 | B1 * | 1/2020 | Turturro | B65D 5/724 |

(Continued)

FOREIGN PATENT DOCUMENTS

| | | | | |
|---|---|---|---|---|
| GB | 2442755 | A * | 4/2008 | A45C 11/04 |

*Primary Examiner* — Rakesh Kumar
(74) *Attorney, Agent, or Firm* — LUEDEKA NEELY GROUP, PC

(57) ABSTRACT

An eye shield dispenser having an outer box and a holder within the outer box for holding eye shields. The holder is configured to hold the eye shields horizontally along an upper surface of the holder and to position the eye shields proximate an opening in the outer box through which the eye shields may be retrieved.

8 Claims, 17 Drawing Sheets

(56) References Cited

U.S. PATENT DOCUMENTS

| | | | | |
|---|---|---|---|---|
| 2014/0319205 | A1* | 10/2014 | Schultz | B65D 5/0245 229/122.1 |
| 2015/0203282 | A1* | 7/2015 | Umentum | B65D 5/724 221/259 |
| 2019/0039776 | A1* | 2/2019 | Kioroglou | B65D 5/4208 |
| 2020/0317391 | A1* | 10/2020 | Schultz | B65D 5/725 |

* cited by examiner

EYE SHIELD DISPENSERS

CROSS-REFERENCE TO RELATED APPLICATION

This application claims priority to U.S. Provisional Application No. 62/805,326 filed Feb. 14, 2019, entitled EYE SHIELD DISPENSERS, incorporated herein by reference in its entirety.

FIELD

The present disclosure relates to containers for storing, shipping, and dispensing goods. More particularly, the disclosure relates to a container for storing, shipping, and dispensing eye shields.

BACKGROUND

Improvement is desired in the provision of containers for storing, shipping, and dispensing eye shields. Prior art dispensers often include a vertical stack of eye shields. This is undesirable for many reasons in that the vertical stack requires an undesirable depth dimension for the dispenser, the eye shields are difficult to load into the dispenser, and the eye shields can become entangled.

The present disclosure provides improved containers for storing, shipping, and dispensing eye shields. The containers of the disclosure advantageously improve over shortcomings of conventional containers.

SUMMARY

The present disclosure provides improved containers for storing, shipping, and dispensing eye shields.

In one aspect, a container according to the disclosure includes a plurality of eye shields each having a pair of arms; an outer box having a front panel and an opening provided on the front panel configured for dispensing the eye shields therethrough; and a holder received within the outer box onto which the eye shields are disposed horizontally along an upper surface of the holder to position the eye shields proximate the opening of the outer box through which the eye shields may be retrieved.

The holder includes a holder body having a pair of spaced apart elongate slots defined on an upper surface of the holder body, the eye shields being aligned horizontally along the upper surface of the holder with the arms of the of the eye shields positioned in the slots of the holder.

In another aspect, a container according to the disclosure includes

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
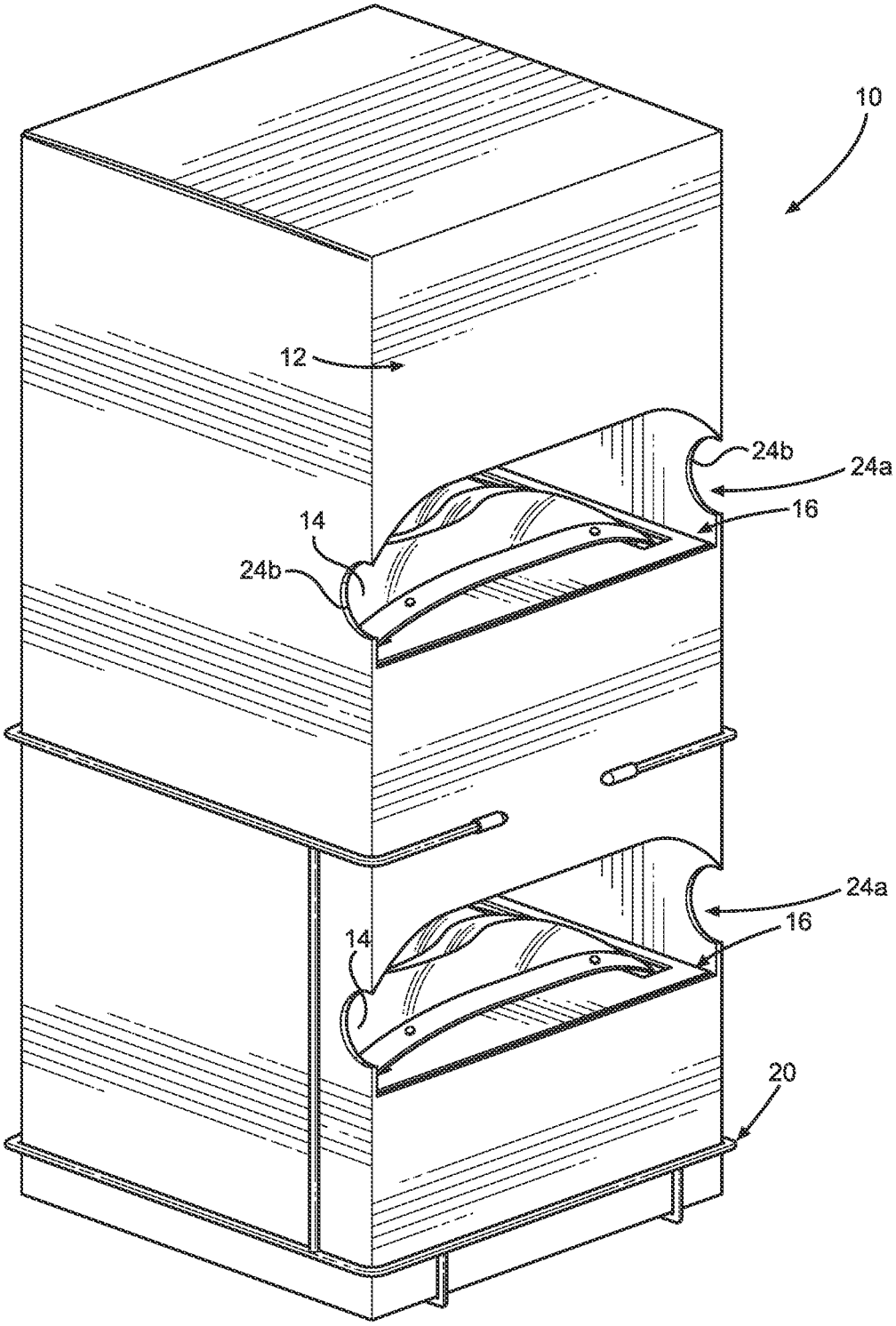
FIGS. 1 and 2 are perspective views of an eye shield dispenser according to the disclosure.
Figure 2:
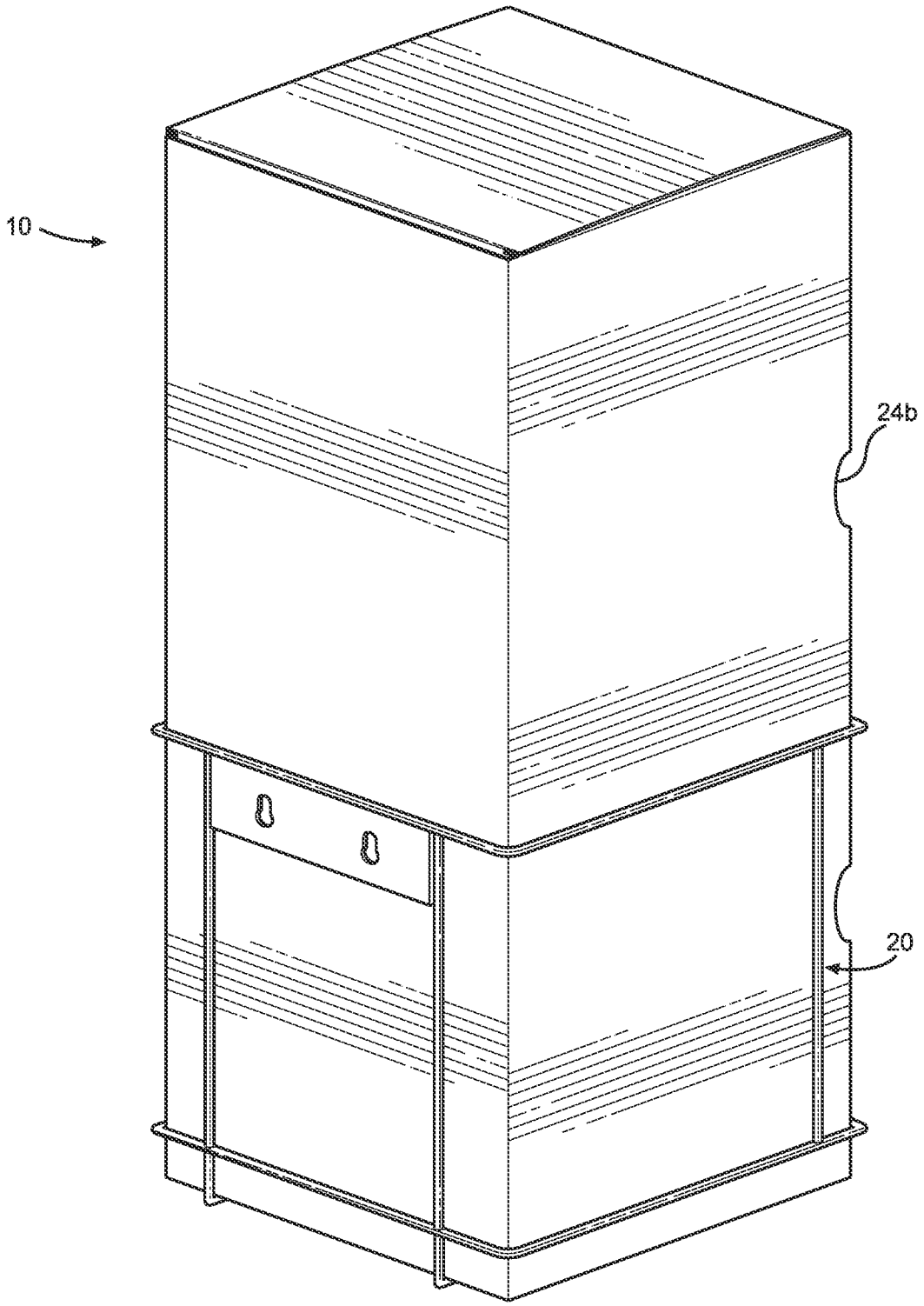
Figure 3:
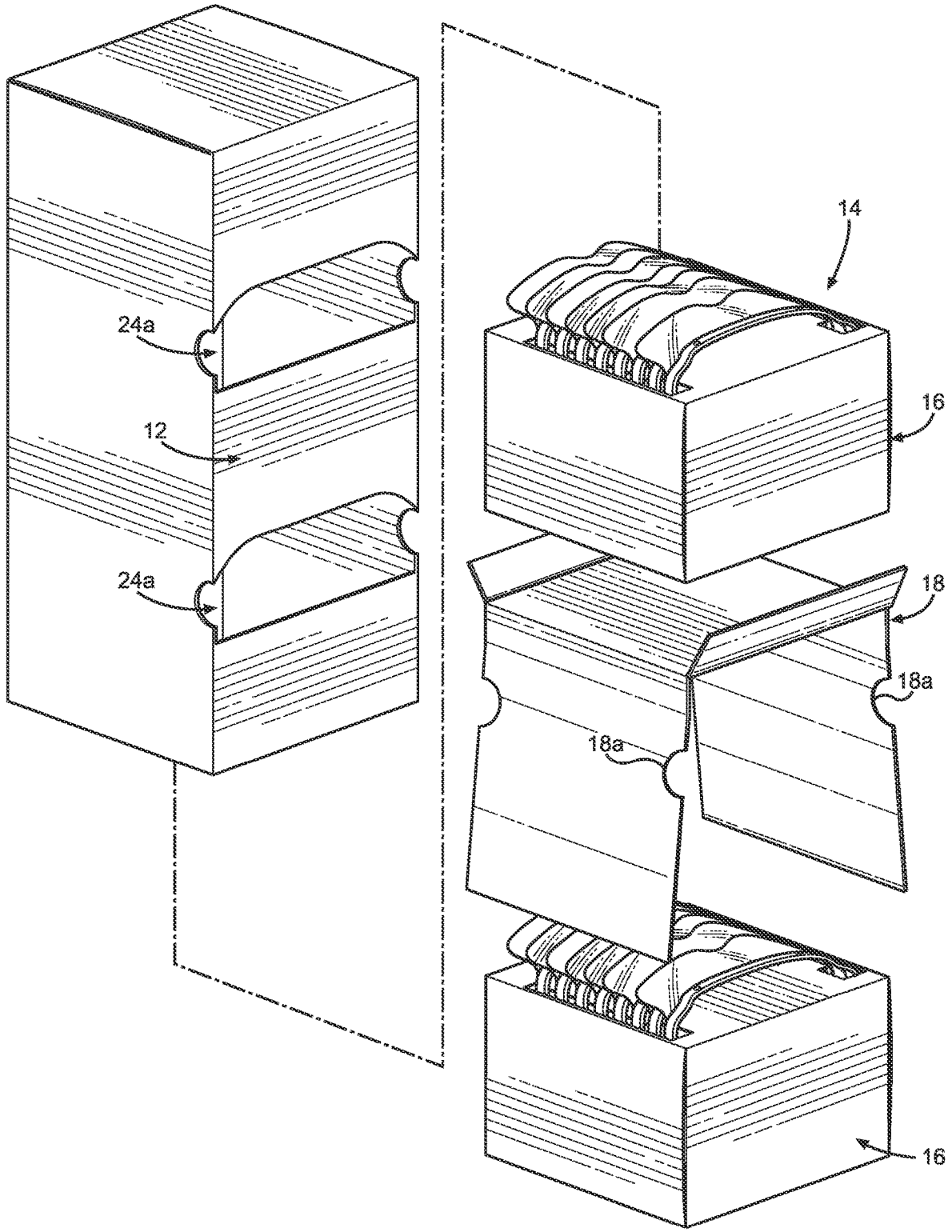
FIG. 3 is an exploded view of the dispenser of FIGS. 1 and 2 showing the components of the dispenser.
Figure 4:
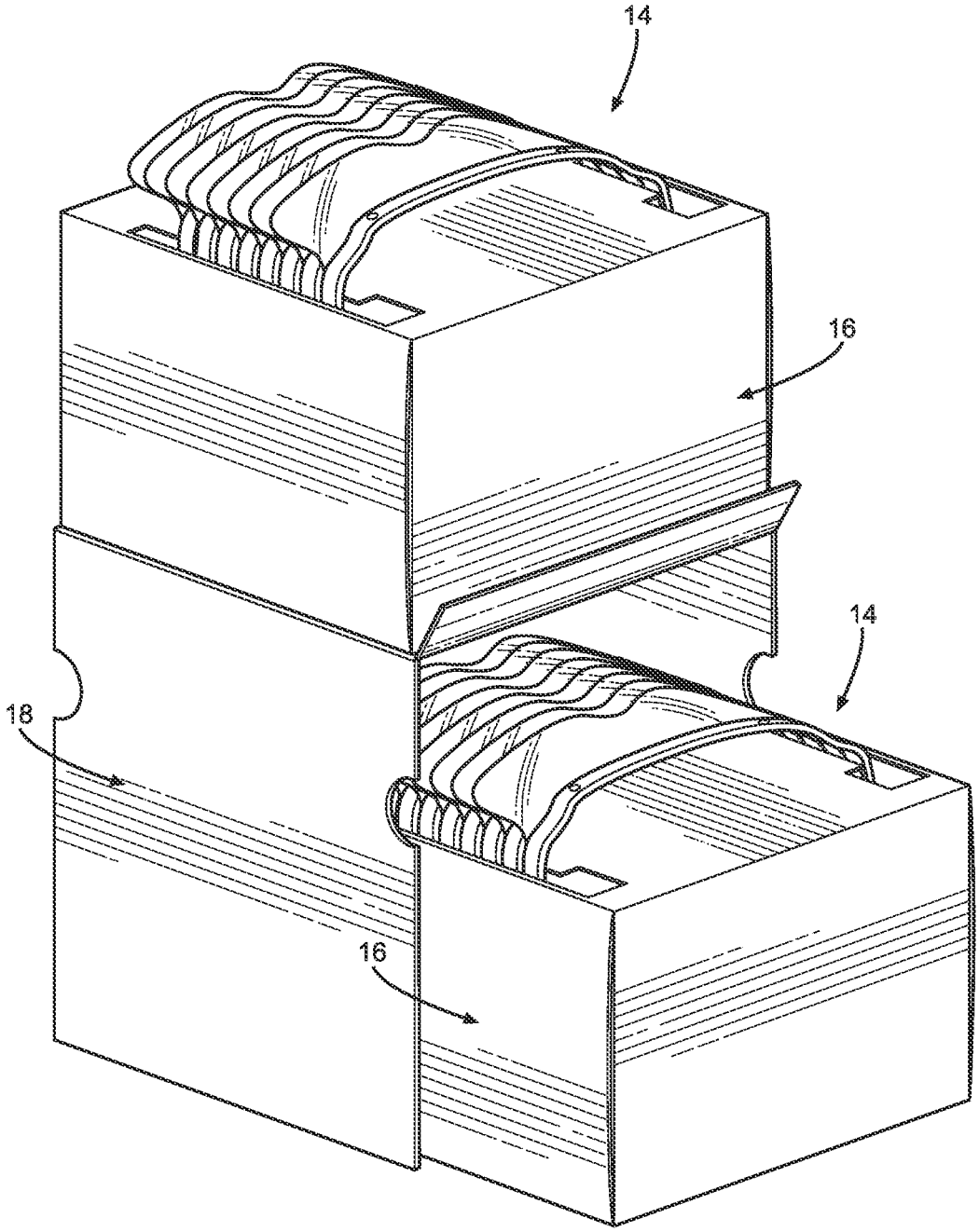
FIGS. 4 and 5 show interior components of the dispenser of FIGS. 1 and 2.
Figure 5:
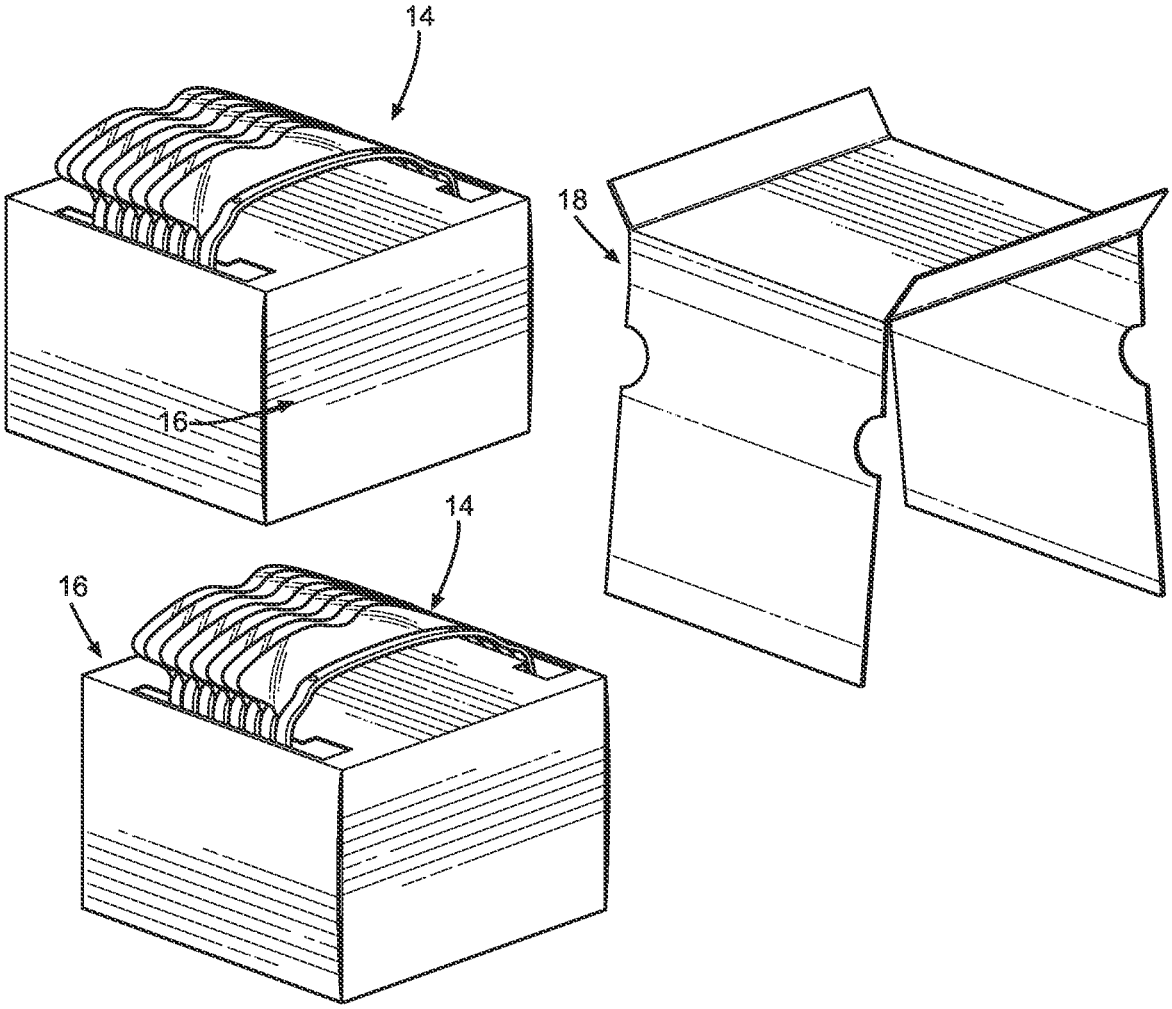

With initial reference to FIGS. 1-10, there is shown an eye shield container 10 having as components an outer box 12, a plurality of eye shields 14, eye shield holders 16, and a holder platform 18. The container 10 may be supported on a wall as by a bracket 20. The container 10 is configured for storing, shipping, and dispensing eye shields.

Figure 8:
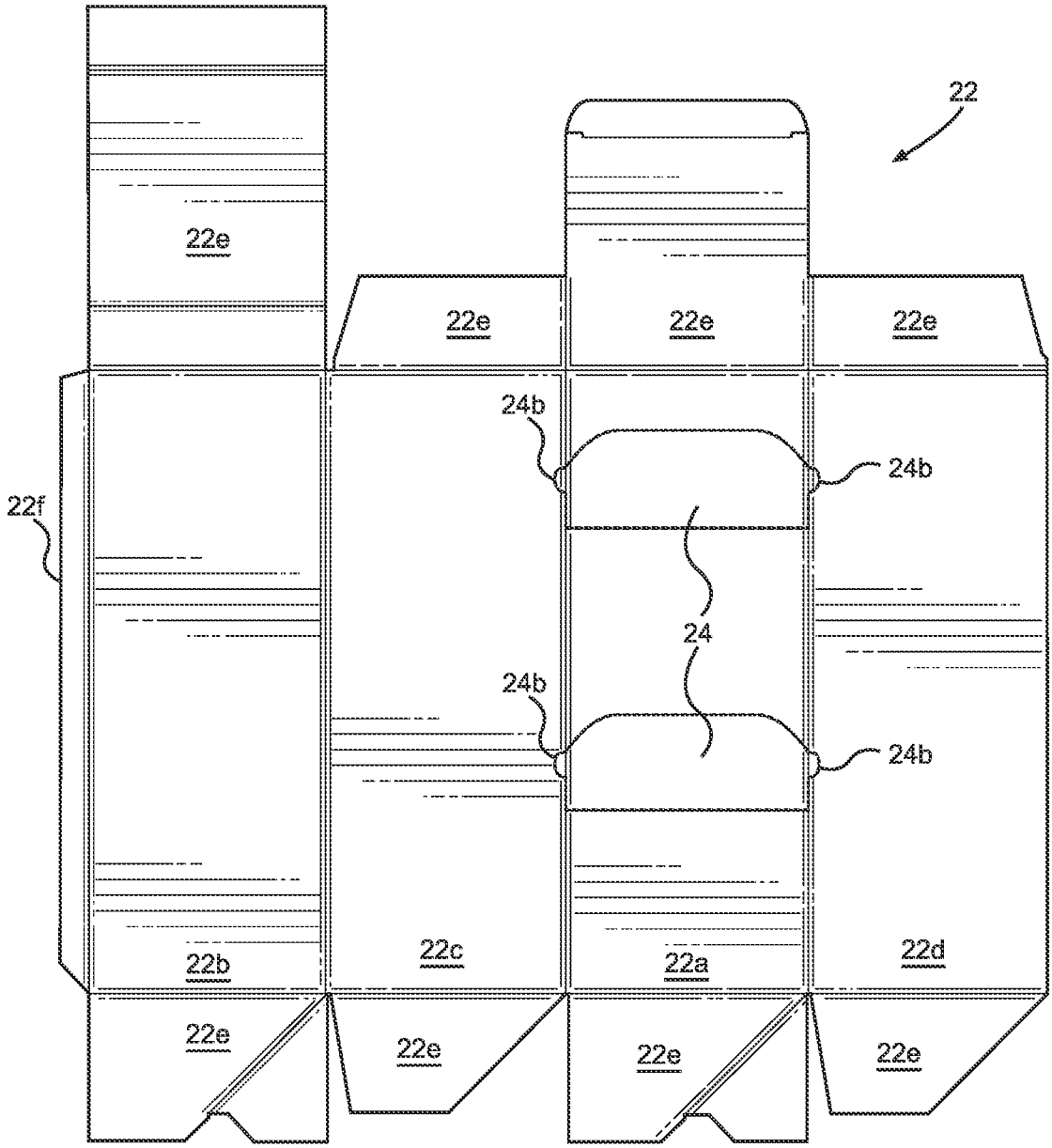
FIG. 8 shows a blank of an outer box of the dispenser of FIGS. 1 and 2.

The outer box 12 is a rectangular box assembled from a blank 22 shown in FIG. 8. The blank 22 includes front panel 22*a*, rear panel 22*b*, and side panels 22*c* and 22*d*. The panels 22*a*-22*d* have cooperating folding flaps 22*e* to provide the outer box 12. For enhanced rigidity of the assembled box 12, the rear panel 22*b* includes an extension 22*f* that may be adhesively secured to an interior surface of the side panel 22*d* during assembly of the box 12.

The outer box 12 includes a pair of scored cutouts 24 located on the front panel 22*a* proximate the locations the holders 16 are positioned in the container 10. The material of the cutouts 24 may be removed to provide openings 24*a* for dispensing the eye shields 14. Open tabs 24*b* are provided on the side panels 22*c* and 22*d* of the box 12 as part of the openings 24*a* to facilitate grasping of the eye shields 14 for removal of the eye shields 14 from the box 12.

Figure 6:
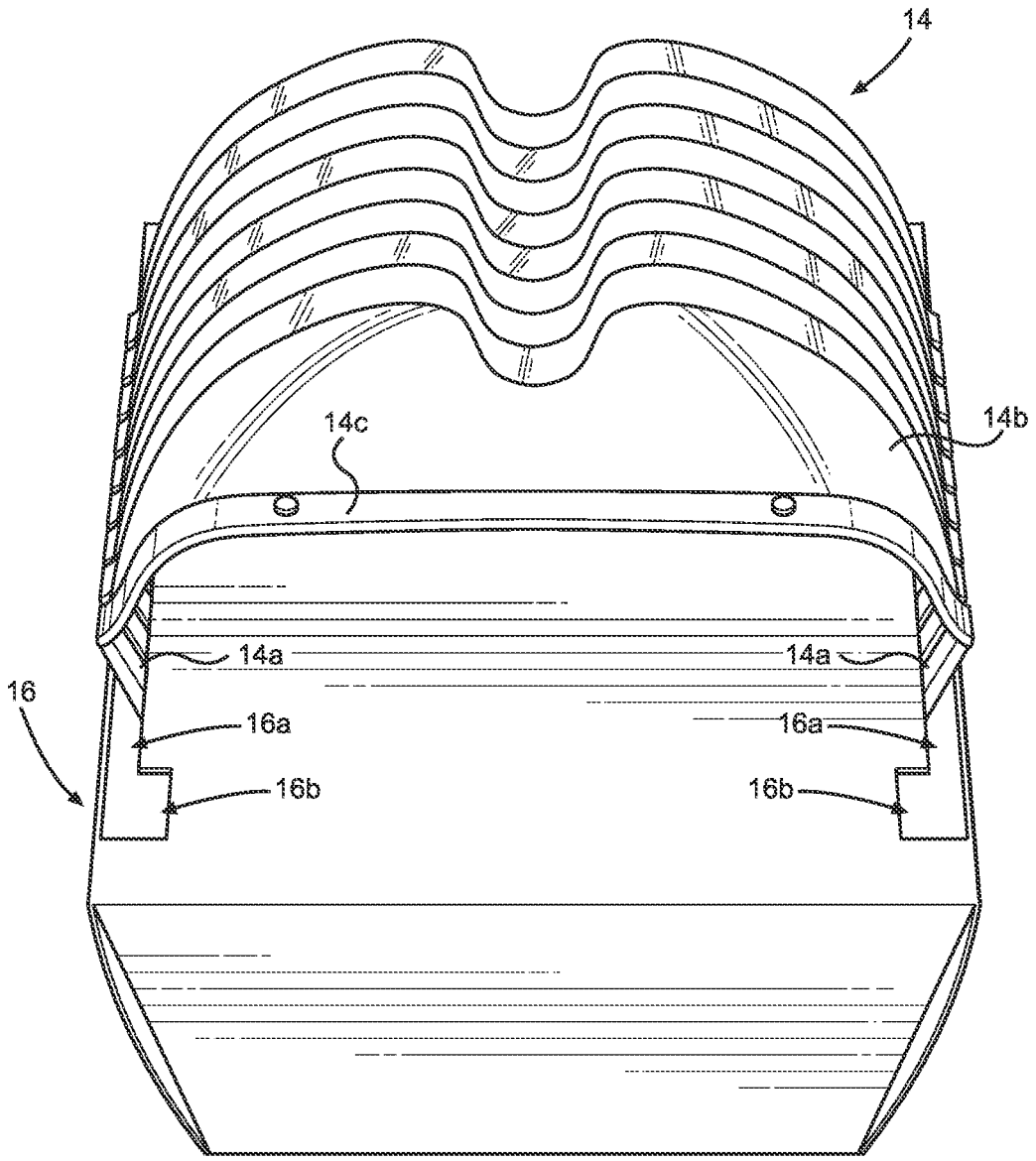
FIGS. 6 and 7 show eye shields and an eye shield holder of the dispenser of FIGS. 1 and 2.
Figure 7:
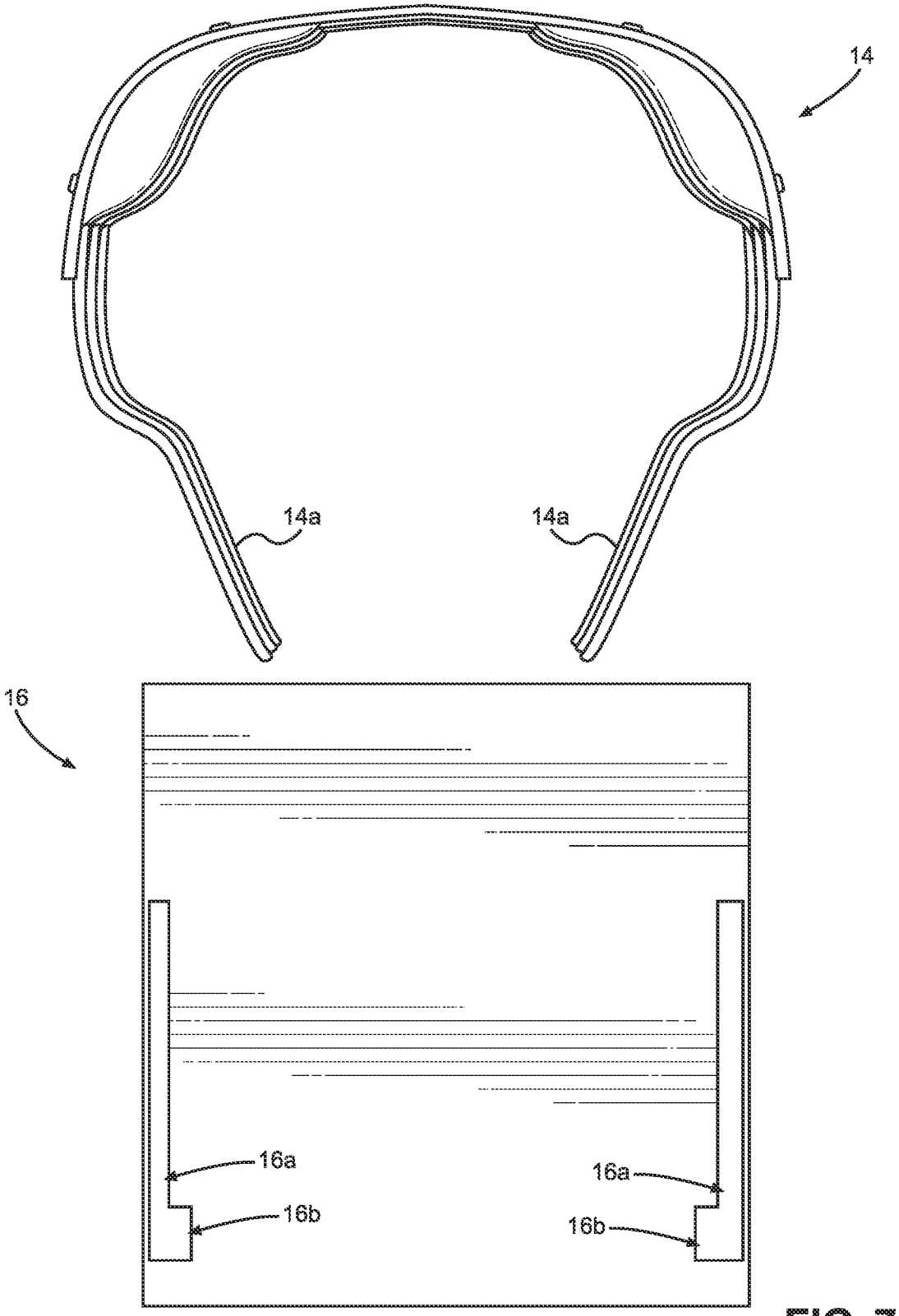

The eye shields 14 have a pair of arms 14*a* located on opposite sides of a preferably transparent shield 14*b* attached to a frame 14*c* (FIG. 6). As shown, the arms 14*a* connect to the frame 14*c* to extend generally perpendicularly away from the frame 14*c*. As shown, the arms 14*a* are fixed or non-moving. However, it will be appreciated that the container 10 may be utilized with shields or glasses of the type having pivoting arms and having a lens for each eye versus a shield that covers both eyes. Also, the arms 14*b* and the frame 14*c* may be provided as a unitary piece.

Figure 9:
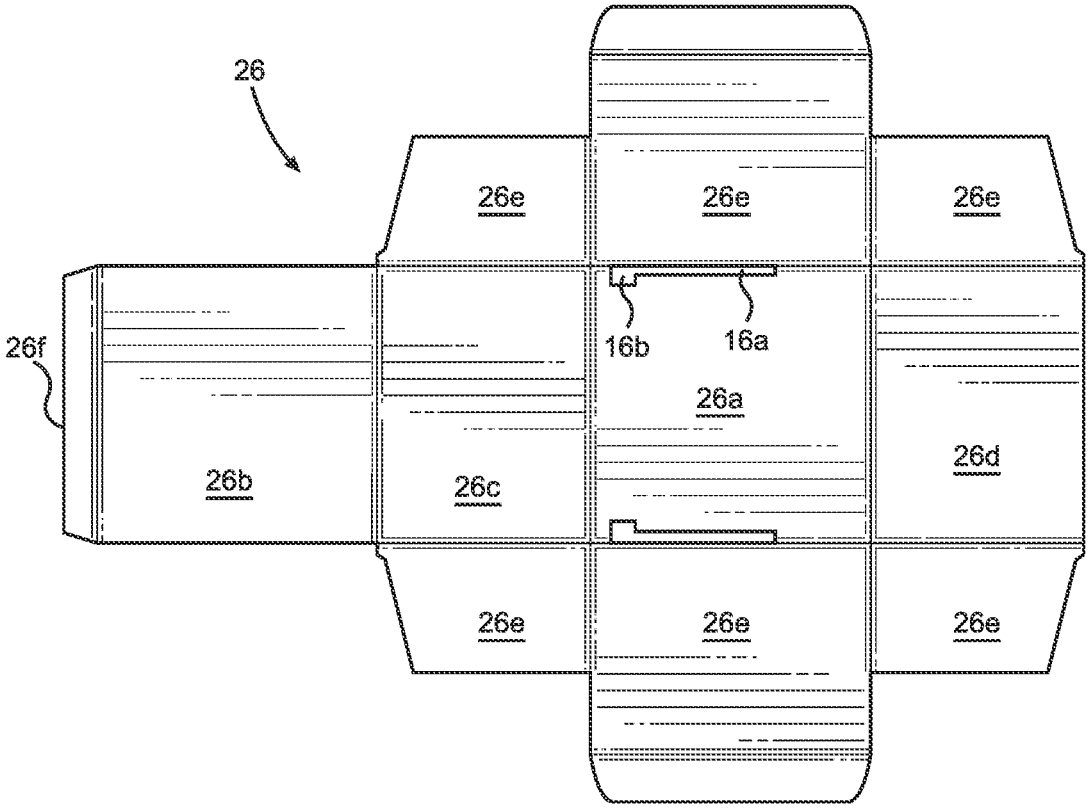
FIG. 9 shows a blank of an eye shield holder of the dispenser of FIGS. 1 and 2.

The holders 16 are each assembled into a box-like rectangular shape from a blank 26 shown in FIG. 9. The blank 26 includes upper panel 26*a*, bottom panel 26*b*, and side panels 26*c* and 26*d*. The panels 26*a*-26*d* have cooperating folding flaps 26*e* to provide the holder 16. For enhanced rigidity of the assembled holder 16, the bottom panel 26*b* includes an extension 26*f* that may be adhesively secured to an interior surface of the side panel 26*d* during assembly of the holder 16.

Each holder 16 includes a pair of spaced apart elongate slots 16*a* defined on the upper panel 26*a* of the holder 16. A proximal end of each slot 16*a* has a slot enlargement 16*b* extending inwardly perpendicular to the length of the slot 16*a*. The eye shields 14 are aligned horizontally along the upper panel 26*a* of the holder 16 with the arms 14*a* of the of the eye shields 14 positioned in the slots 16*a* of the holder 16. Each set of eye shields 14 are preferably arranged one against the other on the holder 16 in a common relative orientation as shown so that the frame 14*c* of the eye shield 14 that is closest to the opening 24*a* is presented to a user for grasping, and the enlargements 16*b* are adjacent the opening 24*a*. The enlargements 16*b* facilitate removal of the arms 14*a* from the slots 16*a* for dispensing of the eye shields 14 through the openings 24*a*.

Figure 10:
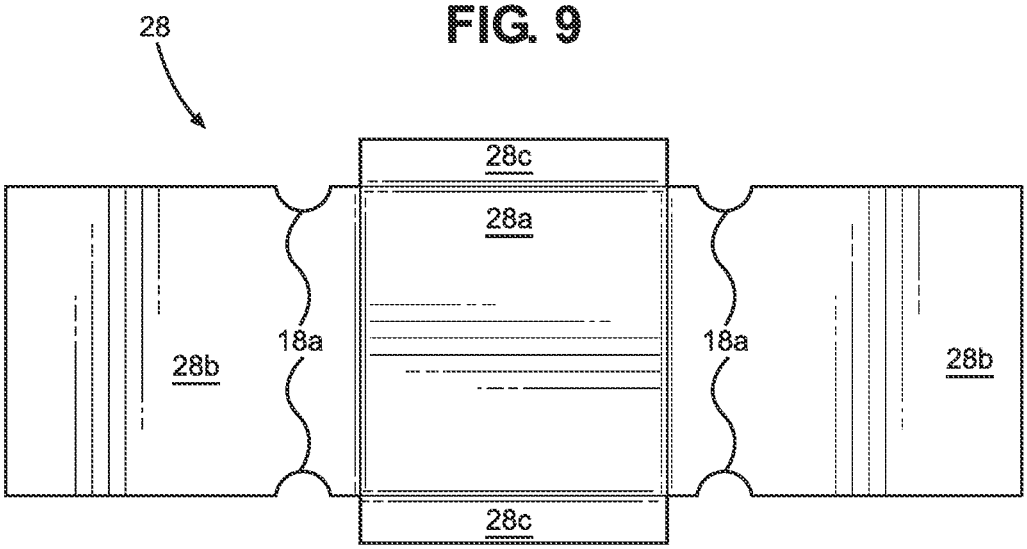
FIG. 10 shows a blank of a platform of the dispenser of FIGS. 1 and 2.
Figure 11:
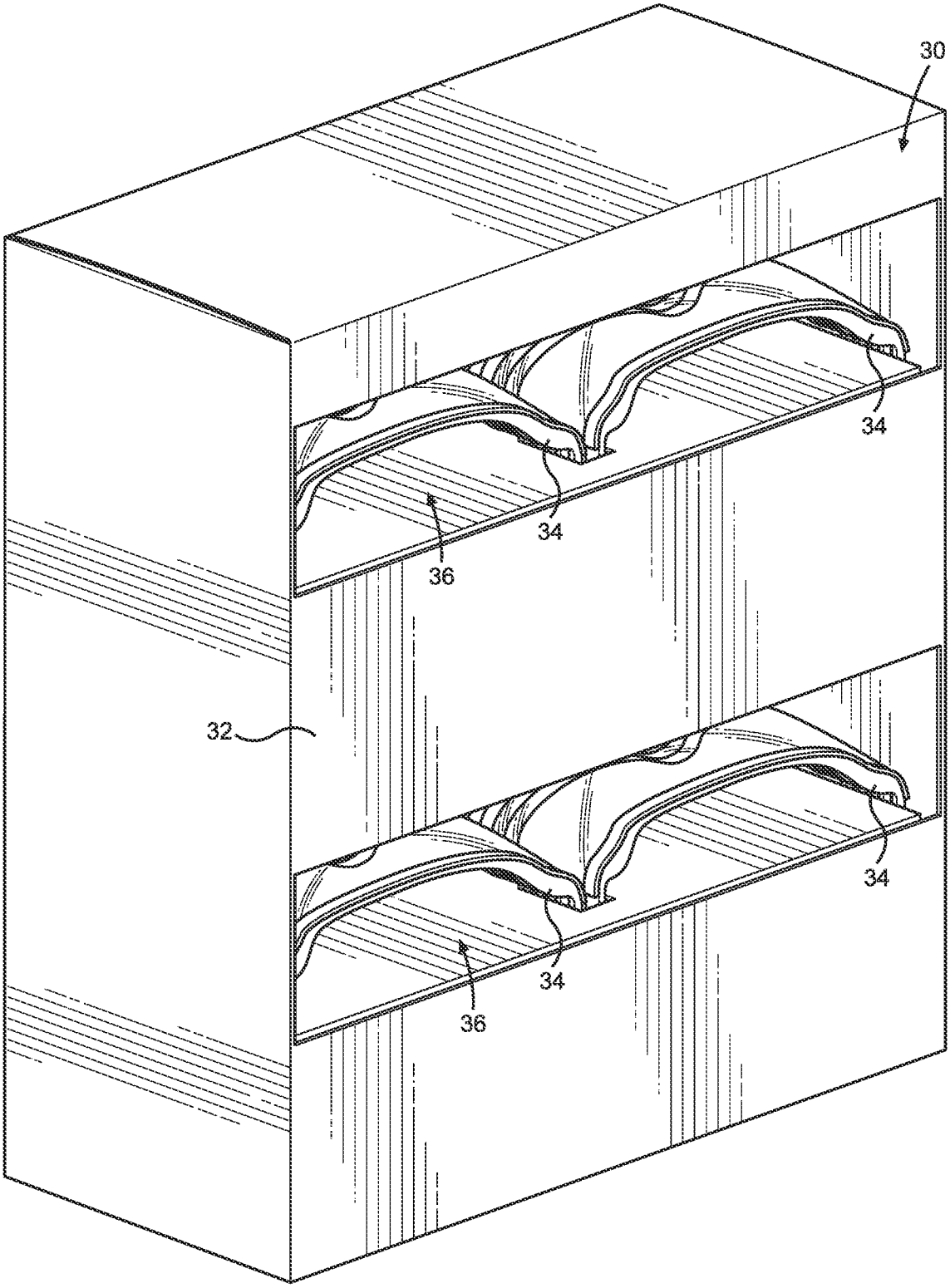
FIGS. 11-12 show another embodiment of an eye shield dispenser according to the disclosure.
Figure 12:
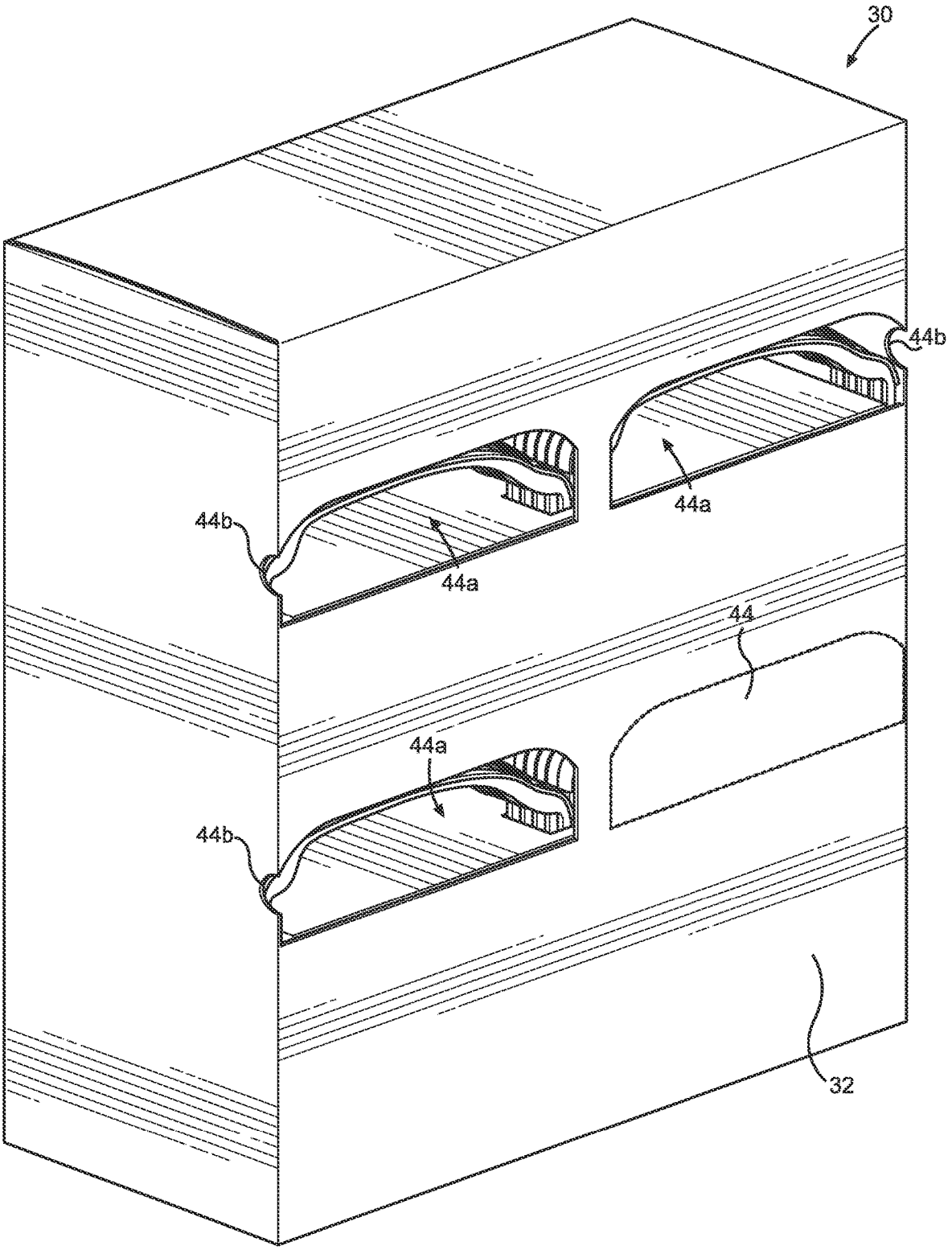

The platform 18 is assembled from a blank 28 shown in FIG. 10. The blank 28 includes an upper panel 28*a* and legs 28*b* located on either side of the upper panel 28*a*. Flaps 28*c* bear against interior surfaces of the outer box 12 and may be adhered thereto for additional stability.

The legs 28*b* support the upper panel 28*a* to provide the platform 18 as a u-shaped support. The platform 18 is located in the outer box 12 to overlie a lower one of the holders 16 to support the other holder 16 above the lower holder 16 and to protect the eye shields 14 therein from the weight of the holder 16 located above. Open tabs 18*a* are provided on edges of the legs 28*b* of the platform 18 at locations proximate where the lower cutout 24*b* of the box 12 will be so that the platform 18 does not interfere with the dispensing of the eye shields 14. The tabs 18*a* are provided on the opposite edges to facilitate installation of the platform 18 so that the tabs 18 are desirably located without having to specifically orient one of the edges of the platform 18.

With reference now to FIGS. 11-20, there is shown an alternate embodiment of an eye shield container 30 having as components an outer box 32, eye shields 34, eye shield holders 36, and a holder platform 38. The container 30 will be observed to have a wider width dimension than the container 10, but have a reduced depth dimension than the container 10. This configuration is desirable for applications where it is desired to reduce the projection of the container into the depth of the room in which the container is mounted. For example, in smaller rooms or locations where persons of more limited mobility may encounter the containers it is desirable to reduce the projection of the container into the room to avoid accidental collisions of persons with the container and aesthetics.

Figure 18:
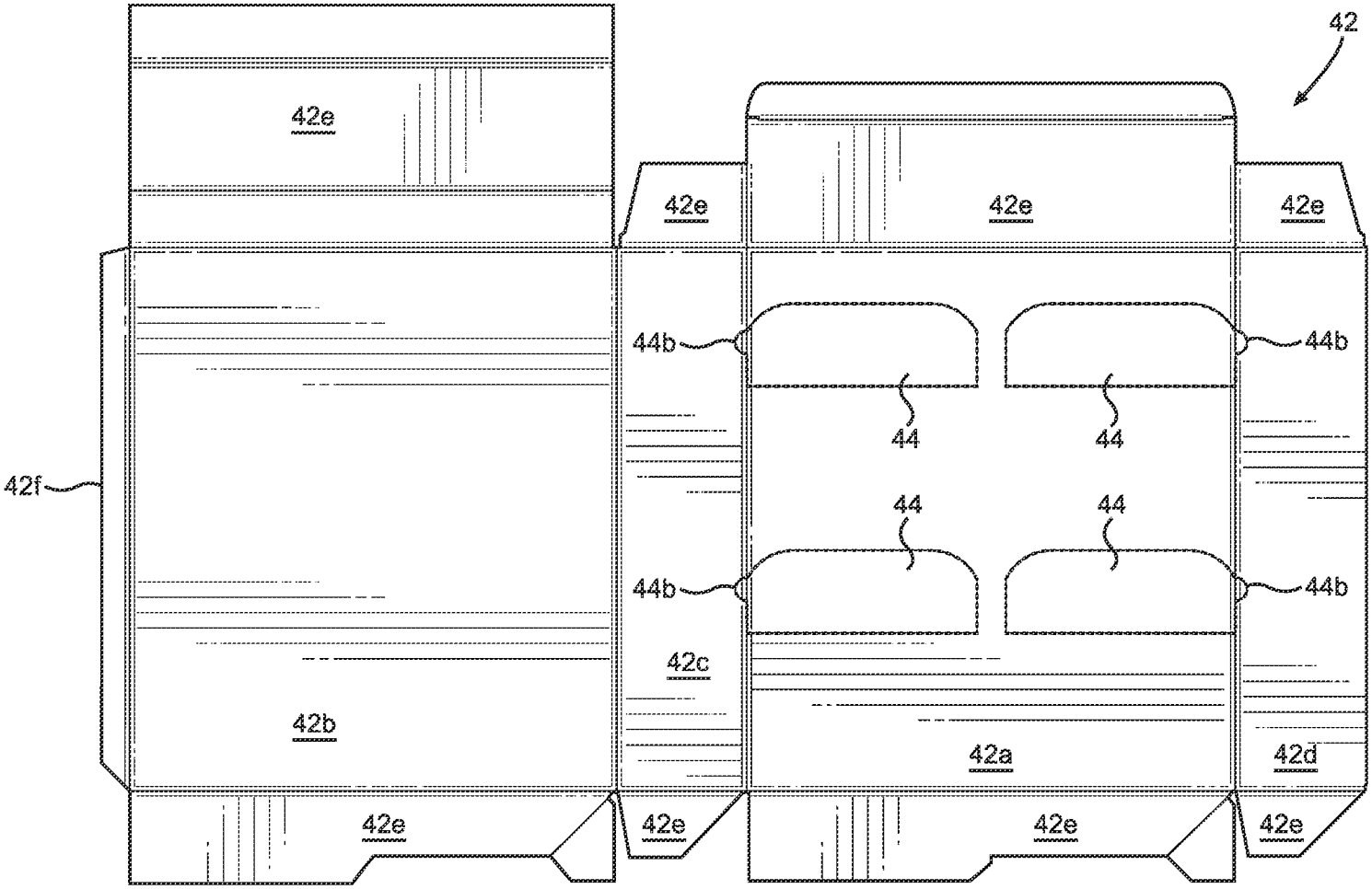
FIG. 18 shows a blank of an outer box of the dispenser of FIGS. 11-12.

The outer box 32 is assembled from a blank 42 shown in FIG. 18. The blank 42 includes front panel 42*a*, rear panel 42*b*, and side panels 42*c* and 42*d*. The panels 42*a*-42*d* have cooperating folding flaps 42*e* to provide the outer box 32. For enhanced rigidity of the assembled box 32, the rear panel 42*b* includes an extension 42*f* that may be adhesively secured to an interior surface of the side panel 42*d* during assembly of the box 32.

The box 32 includes four scored cutouts 44 located proximate the locations the holders 36 are positioned in the container 10. The material of the cutouts 44 may be removed to provide openings 44*a* for dispensing the eye shields 44. Open tabs 44*b* are provided on the sides of the box 42 as part of the openings 44*a* to facilitate grasping of the eye shields 34 for removal of the eye shields 34 from the box 32.

Figure 19:
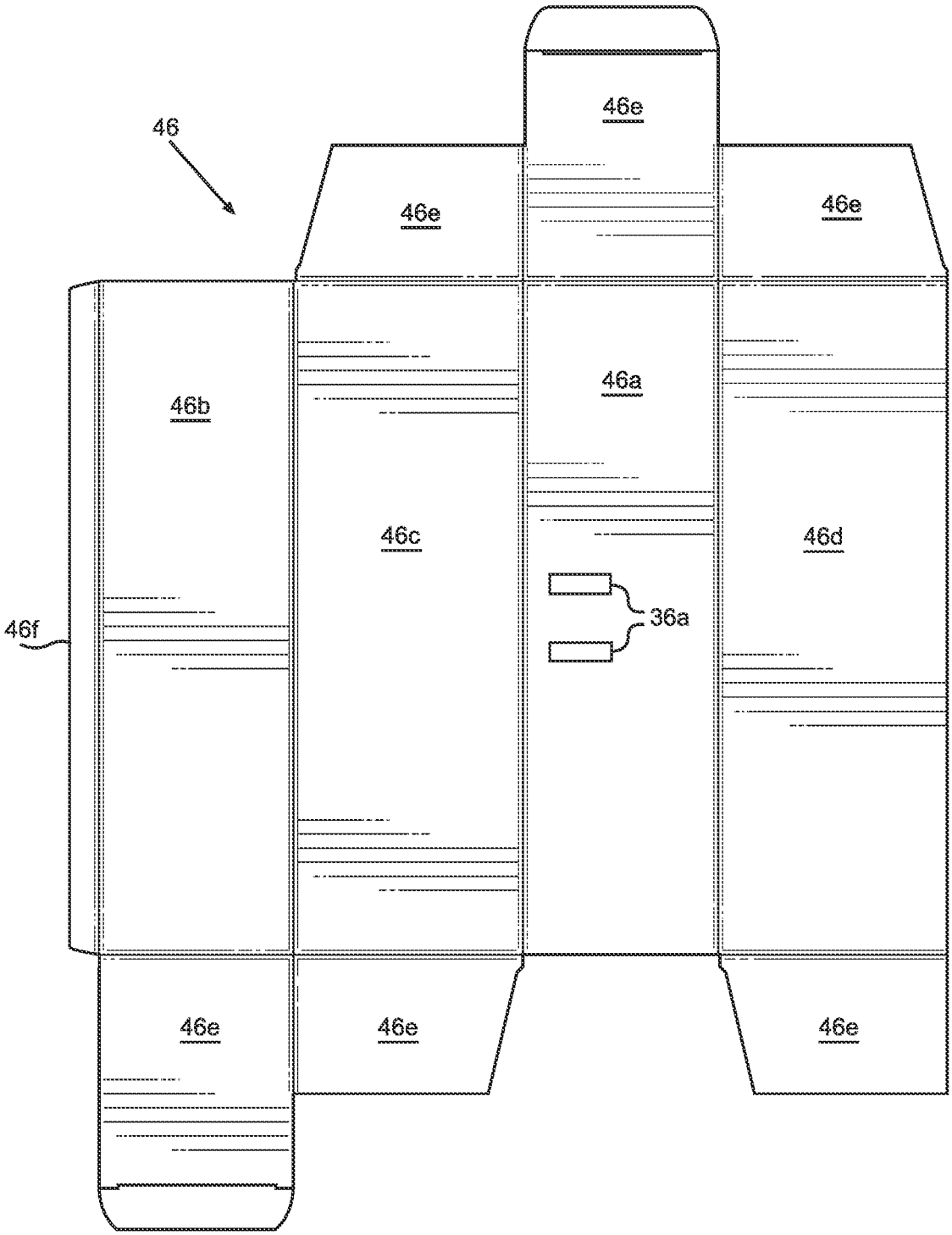
FIG. 19 shows a blank of an eye shield holder of the dispenser of FIGS. 11-12.

The holders 36 are each assembled from a blank 46 shown in FIG. 19. The blank 46 includes upper panel 46*a*, bottom panel 46*b*, and side panels 46*c* and 46*d*. The panels 46*a*-46*d* have cooperating folding flaps 46*e* to provide the holder 36. For enhanced rigidity of the assembled holder 36, the bottom panel 46*b* includes an extension 46*f* that may be adhesively secured to an interior surface of the side panel 46*d* during assembly of the holder 36.

Figure 15:
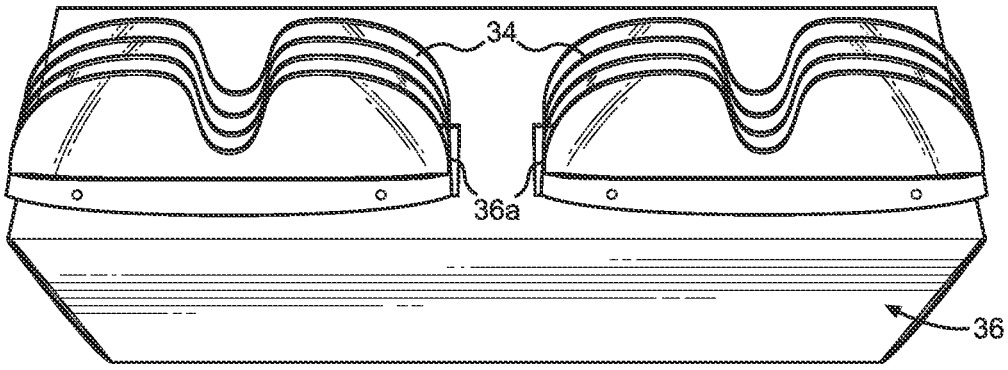
FIGS. 15-17 show eye shields and an eye shield holder of the dispenser of FIGS. 11-12.
Figure 16:
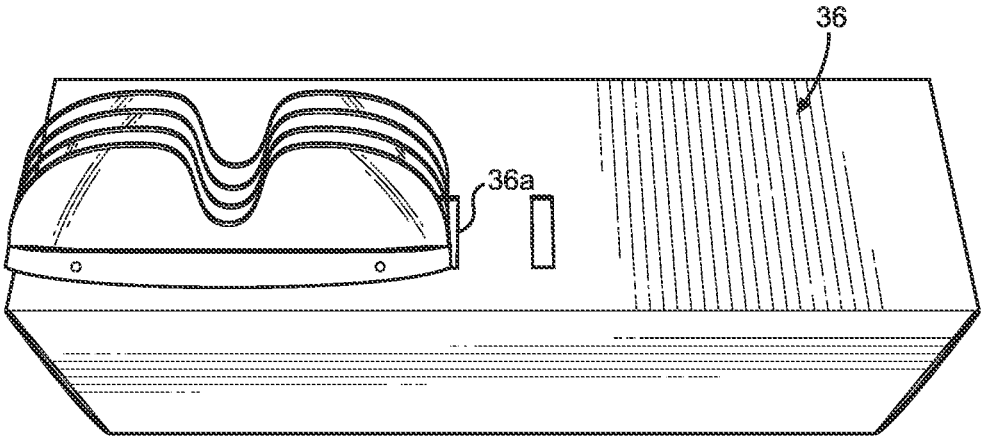
Figure 17:
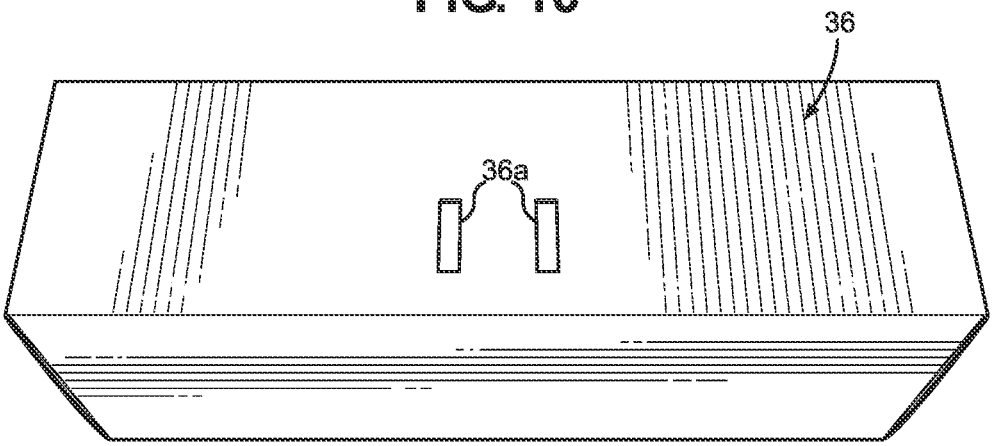

Each holder 36 is a box having a pair of closely spaced apart elongate slots 36*a* defined on an upper surface of the holder 36. The slots 36*a* are located near the center of the length dimension of the holder 36 and adjacent an edge that will be located near the openings 44*a* of the box 32. Two sets of eye shields 34 are aligned horizontally along the upper surface of the holder 36 with one of the arms 34*a* of each set of the of the eye shields 34 positioned in one of the slots 36*a* and the other of the arms 34*a* of each set of the eye shields extending around or past a side of the holder 36, as best seen in FIG. 15.

If desired, the holder 36 may be of smaller dimension and have only one of the slots 36*a* for holding one set of the eye shields 34. In this regard, it will be appreciated that the box would likewise be configured to have only the number of the openings 44*a* as there are sets of the eye shields 34.

Figure 20:
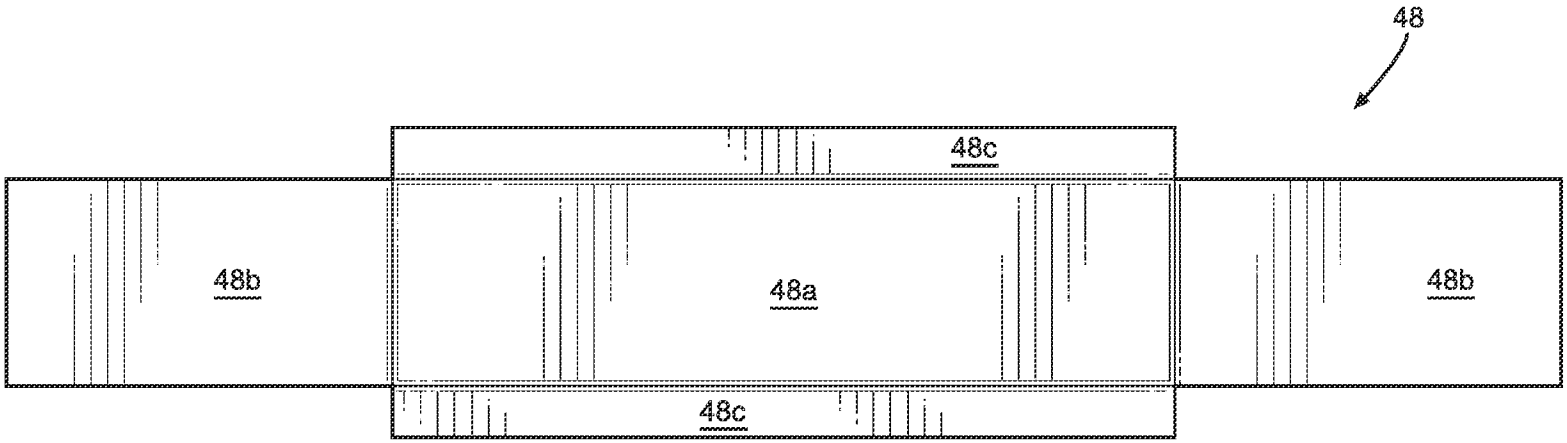
FIG. 20 shows a blank of a platform of the dispenser of FIGS. 11-12.

The platform 38 is assembled from a blank 48 shown in FIG. 20. The blank 48 includes an upper panel 48*a* and legs 48*b* located on either side of the upper panel 48*a*. Flaps 48*c* bear against interior surfaces of the outer box 32 and may be adhered thereto for additional stability.

Figure 13:
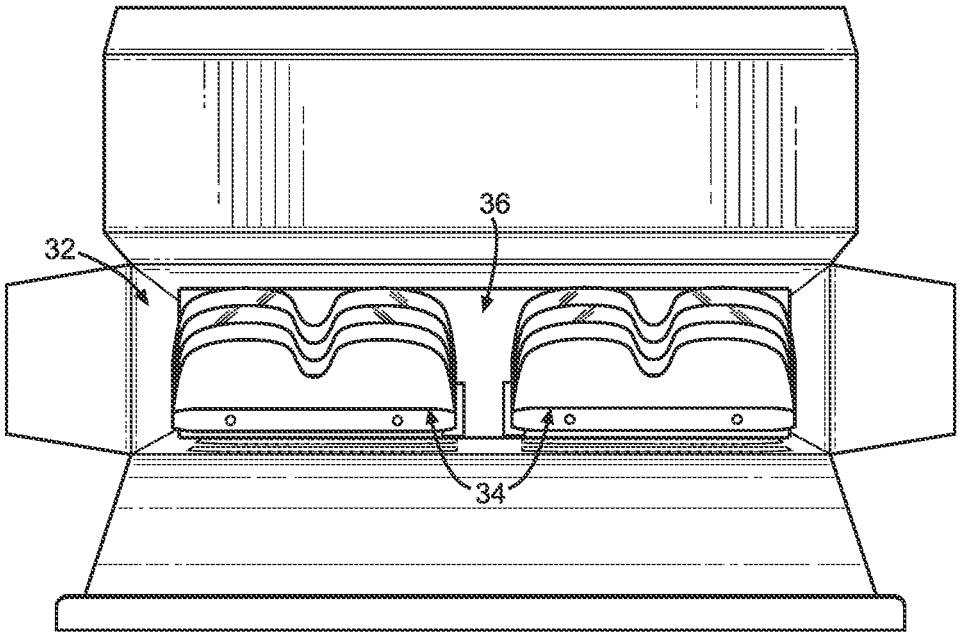
FIGS. 13 and 14 are interior view of the eye shield dispenser of FIGS. 11-12.
Figure 14:
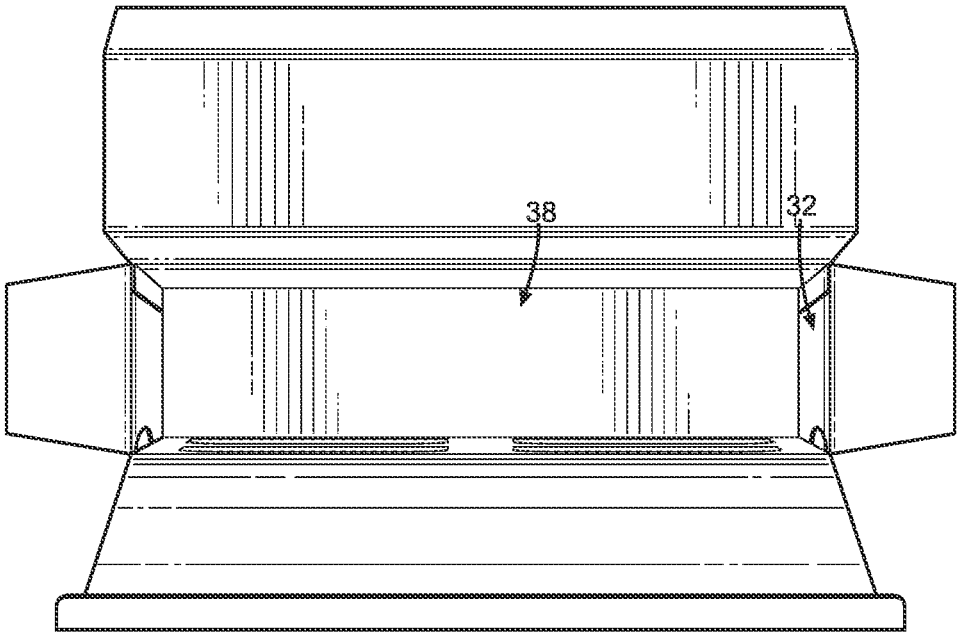

The platform 38 is a u-shaped support that overlies a lower one of the holders 36 to support the other holder 36 above the lower holder 36 and to protect the eye shields 34 therein from the weight of the holder 36 located above. FIG. 13 shows the lower holder 36 with the platform 38 and the upper holder 36 removed, and FIG. 14 shows the platform 38 installed and ready to receive the upper holder 36.

Figure 21:
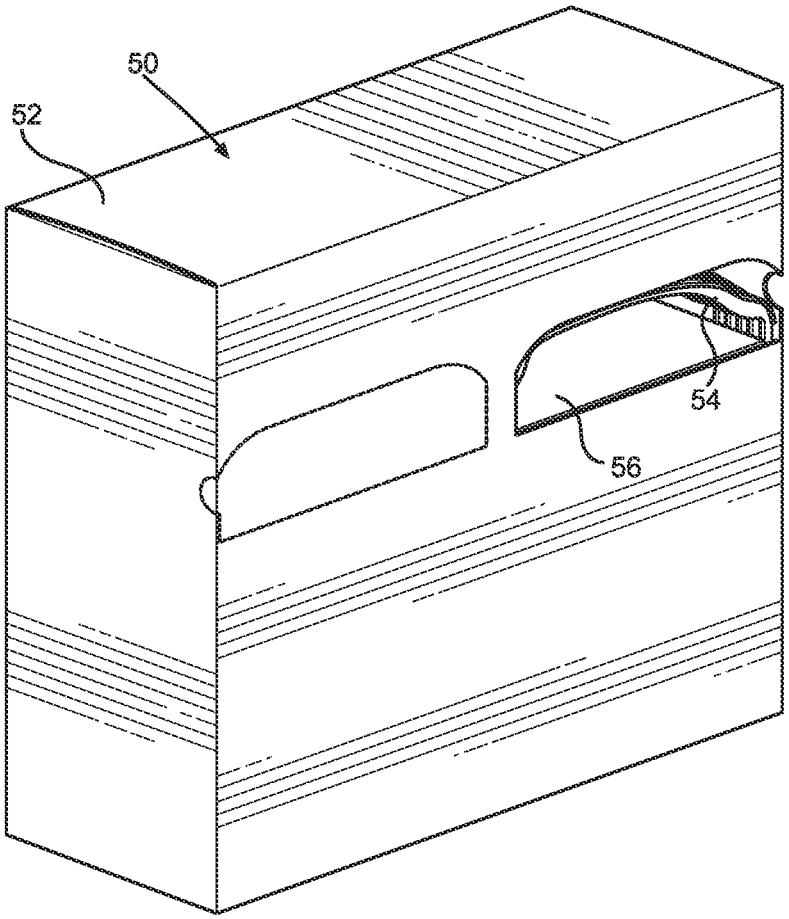
FIGS. 21-22 show a further embodiment of an eye shield dispenser according to the disclosure.
Figure 22:
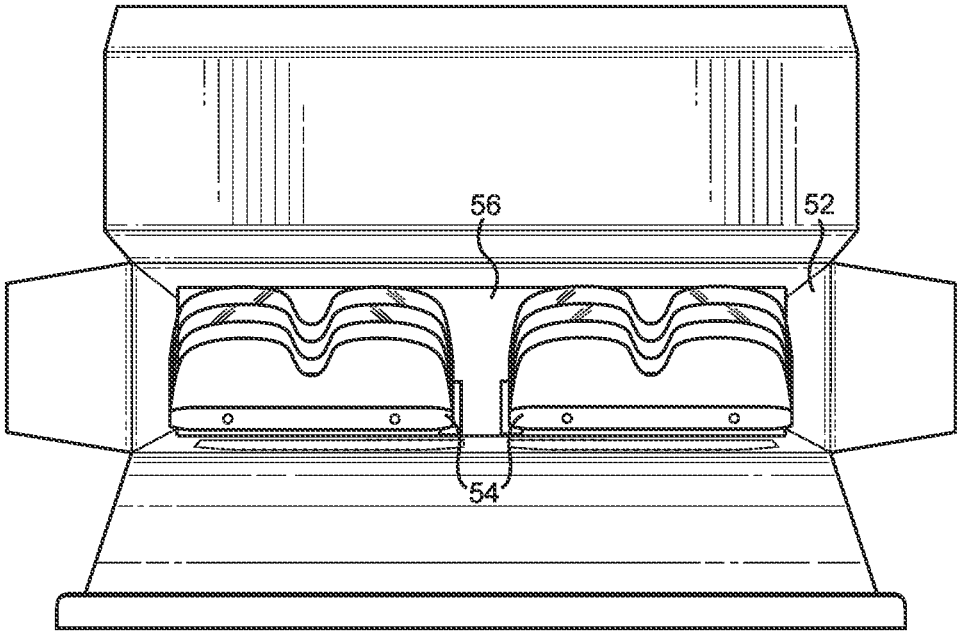

With reference now to FIGS. 21-22, there is shown an alternate embodiment of an eye shield container 50. The container 50 is substantially similar to the container 30 and includes an outer box 52 and eye shields 54, but it has only a single holder 56 that corresponds to the holder 36 described above and does not include any structure corresponding to the platform 38 since there is only a single holder. This configuration provides both reduced depth and height dimensions. For example, this configuration desirably has a maximum depth of about 4 inches so as to reduce projection of the container into the depth of the room in which the container is mounted.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A container configured for storing, shipping, and dispensing eye shields, the container comprising:

a plurality of eye shields each having a pair of arms;

an outer box having a front panel and an opening provided on the front panel configured for dispensing the eye shields therethrough; and a holder received within the outer box onto which the eye shields are disposed horizontally along an upper surface of the holder to position the eye shields proximate the opening of the outer box through which the eye shields may be retrieved, the holder comprising a holder body having a pair of spaced apart elongate slots defined on an upper surface of the holder body and offset from edges of the upper surface, the eye shields being aligned horizontally along the upper surface of the holder with the arms of the eye shields positioned in the slots of the holder.

2. The container of claim 1, wherein a proximal end of each elongate slot of the holder has a slot enlargement extending inwardly perpendicular to a length of the slot.

3. The container of claim 2, wherein the enlargements are adjacent the opening.

4. The container of claim 1, wherein the eye shields are arranged one against the other on the holder in a single file orientation so that a frame of the eye shield that is closest to the opening is presented to a user for grasping.

5. The container of claim 1, wherein the container has two holders stacked one above the other for receiving the eye shields as two sets of eye shields, with a platform supporting an upper one of the holders above a lower one of the holders adjacent the opening of the box, wherein the box includes another lower opening and the lower one of the holders is adjacent the other lower opening.

6. The container of claim 5, wherein the platform includes open tabs on the legs of the platform so that when the platform is installed in the outer box, the open tabs are proximate the lower opening of the outer box such that the platform does not interfere with the dispensing of the eye shields.

7. The container of claim 6, wherein the open tabs are provided on the opposite edges of the legs to facilitate installation of the platform so that at least some of the tabs are located proximate the lower opening of the outer box without having to specifically orient one of the edges of the platform.

8. The container of claim 1, wherein the container has a depth dimension of about 4 inches or less.

* * * * *